US007297070B2

(12) United States Patent
Ashida et al.

(10) Patent No.: US 7,297,070 B2
(45) Date of Patent: Nov. 20, 2007

(54) GOLF CLUB SHAFT SELECTING SYSTEM AND GOLF CLUB SHAFT SELECTING METHOD

(75) Inventors: Hiroki Ashida, Osaka (JP); Takeshi Saito, Osaka (JP); Toshimitu Shimizu, Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 11/170,117

(22) Filed: Jun. 28, 2005

(65) Prior Publication Data

US 2006/0211510 A1 Sep. 21, 2006

(30) Foreign Application Priority Data

Mar. 18, 2005 (JP) ..... 2005-079977

(51) Int. Cl.
*A63B 53/00* (2006.01)

(52) U.S. Cl. ..... 473/223; 473/409; 73/491; 73/849

(58) Field of Classification Search ..... 473/409, 473/289, 221–223; 73/12.04, 781–782, 788–792, 73/847, 849, 491–492, 503; 702/182–183
See application file for complete search history.

(56) References Cited

U.S. PATENT DOCUMENTS

| | | | | |
|---|---|---|---|---|
| 5,156,396 | A * | 10/1992 | Akatsuka et al. | 473/319 |
| 6,014,887 | A * | 1/2000 | Naruo et al. | 73/12.04 |
| 6,213,888 | B1 * | 4/2001 | Kawaguchi et al. | 473/223 |
| 6,328,660 | B1 * | 12/2001 | Bunn, III | 473/257 |
| 7,041,014 | B2 * | 5/2006 | Wright et al. | 473/409 |
| 2003/0008731 | A1 * | 1/2003 | Anderson et al. | 473/407 |

FOREIGN PATENT DOCUMENTS

| | | |
|---|---|---|
| JP | 10-043332 | 2/1998 |
| JP | 2001-070482 | 3/2001 |
| JP | 2003-205053 | 7/2003 |
| JP | 2003-284802 | 10/2003 |
| JP | 2004-129687 | 4/2004 |
| WO | WO96/11726 | 4/1996 |

OTHER PUBLICATIONS

Advertisement of Mizuno Corporation's product "MP-001" in the "Weekly Golf Digest," Golf Digest Sha Co., Ltd., Oct. 5, 2004, pp. 22-23.
"Select by Swing Tempo/The True Shaft Selection (first half)," in "Weekly Golf Digest," Golf Digest Sha Co., Ltd., Oct. 12, 2004, pp. 186-191.
"Select by Swing Tempo/The True Shaft Selection (latter half)," in "Weekly Golf Digest," Golf Digest Sha Co., Ltd., Oct. 19, 2004, pp. 176-179.

* cited by examiner

*Primary Examiner*—Stephen Blau
(74) *Attorney, Agent, or Firm*—Troutman Sanders LLP; James E. Schutz

(57) ABSTRACT

A golf club shaft selecting system includes a head speed detecting unit detecting a head speed at impact in a swing of a golfer, a swing tempo detecting unit detecting a swing tempo of the golfer, a chart indicative of a shaft mass and a shaft flex point corresponding to the swing characteristics of each golfer, a selecting unit selecting a golf club shaft suitable for the golfer referring to the chart and based on the head speed and the swing tempo detected by the head speed detecting unit and the swing tempo detecting unit, and a displaying apparatus displaying the golf club shaft selected by the selecting unit.

6 Claims, 18 Drawing Sheets

GOLF CLUB SHAFT SELECTING SYSTEM AND GOLF CLUB SHAFT SELECTING METHOD

This Application claims priority from Japanese Patent Application No. 2005-079977, bearing filing date Mar. 18, 2005.

BACKGROUND OF THE INVENTION

1. Field of the Invention

The present invention relates to a golf club shaft selecting system and a golf club shaft selecting method, and particularly, to a golf club shaft selecting system and a golf club shaft selecting method for selecting a golf club shaft suitable for a golfer corresponding to the characteristics of the swing of the golfer.

2. Description of the Background Art

Golf clubs are associated with various flexes and flex points of the shaft, and a golfer needs to select a golf club with the flex and the flex point suitable for him/her.

An example of a golf club shaft selecting system focusing on the flex of the shaft (EI: flexural rigidity) is described in International Publication No. W096/11726. It discloses measuring, for each golfer, one of a swing time, a swing speed (club head speed), a club head acceleration and a distortion amount of the shaft or measuring those items as well as the head speed.

An example of a golf club shaft selecting system focusing on the flexural rigidity distribution (EI distribution) of the shaft is described in Japanese Patent Laying-Open No. 2004-129687. It discloses a system provided with a first analysis system having shaft behavior measuring means for measuring deformation behavior of the shaft during a swing, shaft EI calculating means for calculating an EI distribution of the shaft and shaft shape calculating means for calculating the deformation shape of the shaft during the swing, and a second analysis system having a swing classifying means for analyzing and classifying the swing of the golfer, in order to analyze the deformation behavior of the shaft during the swing, classify the swing of the golfer and select the shaft optimal for the golfer.

An example of a golf club shaft selecting system focusing on the torsional rigidity (torque) of the shaft is described in Japanese Patent Laying-Open No. 2001-070482. It discloses measuring a deformation amount of the shaft in a swing of each golfer, or measuring a head speed while measuring the deformation amount.

Another example of the torsion deformation measuring method is described in Japanese Patent Laying-Open No. 2003-205053. It discloses measuring a torsion deformation generated on the shaft in a swing of a golf club, and based on the time history data of the measured torsion deformation, providing a dynamic evaluation of the shaft including the torsion behavior of the shaft.

An example of a golf club shaft selecting system focusing on a toe-down (droop) amount in a swing is described in Japanese Patent Laying-Open No. 2003-284802. It discloses a method, in which a bending moment distribution on the shaft when a sample golf club is swung is measured, and based on the measured data and a flexural rigidity distribution of the shaft, five factors including "a toe-down amount", which is a deflection amount of the shaft in a direction toward which the toe side of the club head is lowered immediately before the impact, are calculated. Based on the calculation result, a suitable or the optimal shaft for the golfer is selected.

Another example of a method for measuring the aforementioned "toe-down amount" is described in Japanese Patent Laying-Open No. 10-043332. It discloses that a television camera and/or optical detecting means are used when a toe-down amount of a golf club is measured.

However, in selecting a golf club (shaft) by a golfer, no clear selecting criterion has been available as to the selection of the mass and the shaft flex point (EI distribution) of the golf club shaft.

SUMMARY OF THE INVENTION

An object of the present invention is to provide a golf club shaft selecting system and a golf club shaft selecting method that enable selection of a golf club shaft having appropriate shaft mass and shaft flex point.

A golf club shaft selecting system according to the present invention includes a head speed detecting unit detecting a head speed at impact in a swing of a golfer, and a swing tempo detecting unit detecting a swing tempo of the golfer.

According to one aspect, the aforementioned golf club shaft selecting system further includes a chart indicative of a shaft mass corresponding to the head speed and the swing tempo, a selecting unit selecting a golf club shaft suitable for the golfer referring to the chart and based on the head speed and the swing tempo detected by the head speed detecting unit and the swing tempo detecting unit, and a displaying unit displaying the golf club shaft selected by the selecting unit.

With such a configuration, a golf club shaft having a shaft mass suitable for each golfer is selected.

According to another aspect, the aforementioned golf club shaft selecting system further includes a chart indicative of a shaft flex point corresponding to the head speed and the swing tempo, a selecting unit selecting a golf club shaft suitable for the golfer referring to the chart and based on the head speed and the swing tempo detected by the head speed detecting unit and the swing tempo detecting unit, and a displaying unit displaying the golf club shaft selected by the selecting unit.

With such a configuration, a golf club shaft having a shaft flex point suitable for each golfer is selected.

As one example, classification of the shaft flex point in the chart is based on the relationship between a slope of a flexural rigidity distribution of the shaft at a portion positioned on a club head side relative to a shaft central portion and a slope of a flexural rigidity distribution of the shaft at a portion positioned on a grip side relative to the shaft central portion.

According to still another aspect, the aforementioned golf club shaft selecting system further includes a first chart indicative of a preferable shaft mass corresponding to the head speed and the swing tempo, a second chart indicative of a preferable shaft flex point corresponding to the head speed and the swing tempo, a selecting unit selecting a golf club shaft suitable for the golfer referring to the first and second charts and based on the head speed and the swing tempo detected by the head speed detecting unit and the swing tempo detecting unit, and a displaying unit displaying the golf club shaft selected by the selecting unit.

With such a configuration, a golf club shaft having a shaft mass and a shaft flex point suitable for each golfer is selected.

As one example, classification of the shaft flex point in the second chart is based on the relationship between a slope of a flexural rigidity distribution of the shaft at a portion positioned on a club head side relative to a shaft central portion and a slope of a flexural rigidity distribution of the shaft at a portion positioned on a grip side relative to the shaft central portion.

Preferably, in the aforementioned golf club shaft selecting system, the swing tempo detecting unit detects the swing tempo of the golfer based on any of a maximum deflection amount of the shaft in a swing, a swing time period, a club head speed at a prescribed time before reaching top-of-swing, and a club head acceleration around the top-of-swing.

Thus, more precise detection of the swing tempo can be achieved.

It is noted that, in the aforementioned golf club shaft selecting system, "selecting a golf club shaft suitable for a golfer" includes "selecting a golf club suitable for a golfer", and "displaying the selected golf club shaft" includes "displaying the selected golf club".

A golf club shaft selecting method according to the present invention includes the steps of detecting a head speed at impact in a swing of a golfer and a swing tempo of the golfer, and classifying the swing of the golfer based on a detection result from the step of detecting.

According to one aspect, the aforementioned golf club shaft selecting method further includes the step of selecting a golf club shaft having a shaft mass suitable for the golfer based on a classification result from the step of classifying.

With such a configuration, a golf club shaft having a shaft mass suitable for each golfer can be selected.

According to another aspect, the aforementioned golf club shaft selecting method further includes the step of selecting a golf club shaft having a shaft flex point suitable for the golfer based on a classification result from the step of classifying.

With such a configuration, a golf club shaft having a shaft flex point suitable for each golfer can be selected.

According to still another aspect, the aforementioned golf club shaft selecting method further includes the step of selecting a golf club shaft having a shaft mass and a shaft flex point suitable for the golfer based on a classification result from the step of classifying.

With such a configuration, a golf club shaft having a shaft mass and a shaft flex point suitable for each golfer can be selected.

It is noted that, in the aforementioned golf club shaft selecting method, "selecting a golf club shaft suitable for a golfer" includes "selecting a golf club suitable for a golfer".

According to the present invention, as described above, a clear selecting criterion of the mass and the flex point of a golf club shaft can be attained.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

In the following, an embodiment of a golf club shaft selecting system and a golf club shaft selecting method according to the present invention will be described.

Figure 1:
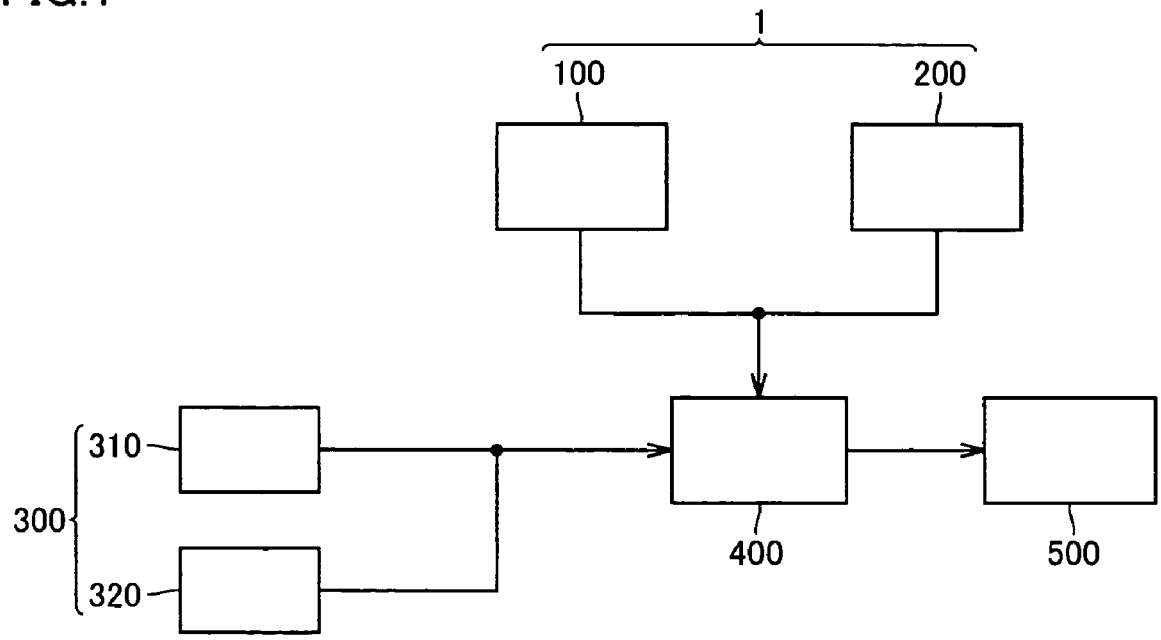
FIG. 1 is a block diagram showing a configuration of a golf club shaft selecting system according to one embodiment of the present invention.

FIG. 1 is a block diagram showing a configuration of a golf club shaft selecting system according to one embodiment of the present invention. Referring to FIG. 1, the golf club shaft selecting system according to the present embodiment includes a head speed detecting unit 100 detecting a head speed at impact in a swing of a golfer, and a swing tempo detecting unit 200 detecting a swing tempo of a golfer. It is noted that head speed detecting unit 100 and swing tempo detecting unit 200 are included in a swing analyzing apparatus 1, which will be described later.

The aforementioned golf club shaft selecting system further includes a chart 300 indicative of a shaft mass and a shaft flex point corresponding to the swing characteristics of each golfer, a selecting unit 400 selecting a golf club shaft suitable for the golfer referring to chart 300 and based on the head speed and the swing tempo detected by head speed detecting unit 100 and swing tempo detecting unit 200, and a displaying apparatus 500 displaying the golf club shaft selected by selecting unit 400. Here, chart 300 includes a first chart 3 10 indicative of a preferable shaft mass corresponding to the head speed and the swing tempo of each golfer, and a second chart 320 indicative of a preferable shaft flex point corresponding to the head speed and the swing tempo of each golfer.

Chart 300 is stored, for example, in a hard disk of a computer. As selecting unit 400, for example, a computer having CPU is used. Displaying apparatus 500 connected to selecting unit 400 may be a display or a printer.

To selecting unit 400, information from swing analyzing apparatus 1 is input. Selecting unit 400 classifies the swing characteristics of each golfer based on an analysis result from swing analyzing apparatus 1 while referring to chart 300, and selects a golf club shaft having a shaft mass and a shaft flex point suitable for each golfer based on the classification result. The selection result is displayed on displaying apparatus 500.

It is noted that chart 300 may be a panel illustrating the relationship between head speed/swing tempo and preferable shaft mass/shaft flex point. Additionally, in place of selecting unit 400, a "person" can select a preferable shaft.

Figure 2:
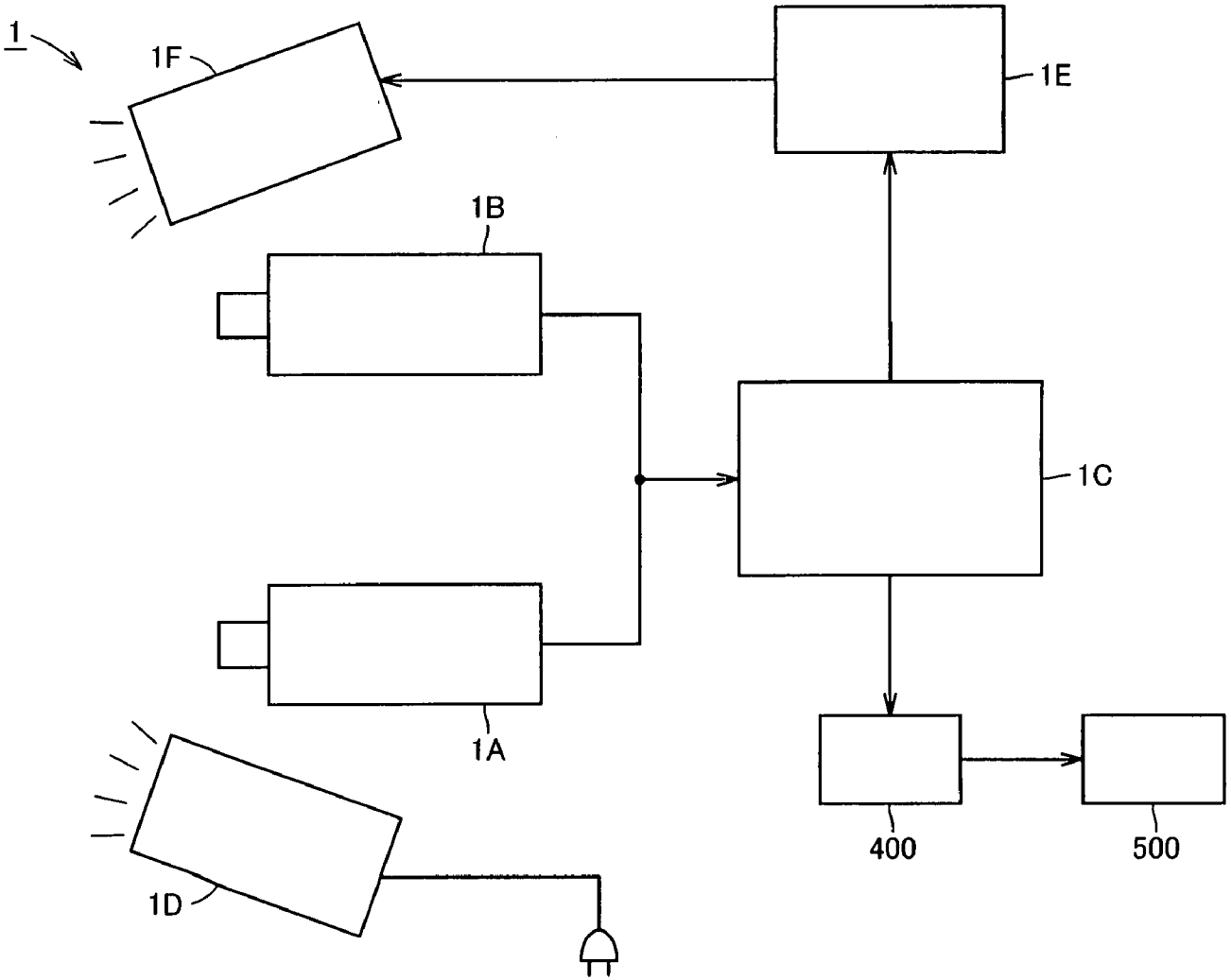
FIG. 2 is a block diagram showing a configuration of the swing analyzing apparatus shown in FIG. 1.
Figure 2:
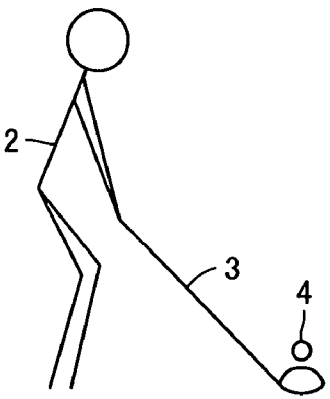

FIG. 2 is a block diagram showing a configuration of the swing analyzing apparatus shown in FIG. 1. Referring to FIG. 2, swing analyzing apparatus 1 analyzes the swing of a golfer 2 when hitting a ball 4 using a golf club 3. Swing analyzing apparatus 1 includes high-speed cameras 1A and 1B, a high-speed video tape recorder 1C, a meta-hexa light 1D, a stroboscope power source 1E, and a stroboscope IF.

High-speed camera 1A shoots ball 4 from the front side. High-speed camera 1B shoots the space above the head of golfer 2 from the front side of the golfer. The number of frame of high-speed cameras 1A and 1B is, for example, 1/200 sec. The outputs of high-speed cameras 1A and 1B are recorded by high-speed video tape recorder 1C. In order to illuminate golfer 2 and ball 4, meta-hexa light 1D is used. In order to provide stroboscopic illumination to golfer 2, stroboscope 1F connected to stroboscope power source 1E is provided. Before golfer 2 starts swinging, stroboscope 1F is activated by stroboscope power source 1E and emits light. Stroboscope 1F is activated by a recording button of high-speed video tape recorder 1C being pressed.

High-speed video tape recorder 1C is connected to displaying apparatus 500 through selecting unit 400 that is a computer having CPU. The image recorded with high-speed video tape recorder 1C is displayed on displaying apparatus 500.

Next, an operation of swing analyzing apparatus 1 is described. First, the recording button of high-speed video tape recorder 1C is operated to start recording. Here, stroboscope 1F emits light by stroboscope power source 1E. When golfer 2 swings golf club 3, the image around ball 4 is shot by high-speed camera 1A, and the image around top-of-swing (the position at which a club head comes to rest above the head of the golfer) is shot by high-speed camera 1B. The images shot by high-speed cameras 1A and 1B are recorded with high-speed video tape recorder 1C. When swinging again, high-speed video tape recorder 1C is paused and the same operation is repeated. When finishing the swing measurement, the recording with high-speed video tape recorder 1C is stopped.

Next, the tape is rewound to replay the image recorded with high-speed video tape recorder 1C on displaying apparatus 500. By a frame-advance operation, a swing start time point and an impact time point are detected. Thus, a "swing time period" from the swing start to the impact is detected. The "swing time period" can be one indication of the "swing tempo". By the frame-advance operation, the head speed at impact can be detected.

Figure 3:
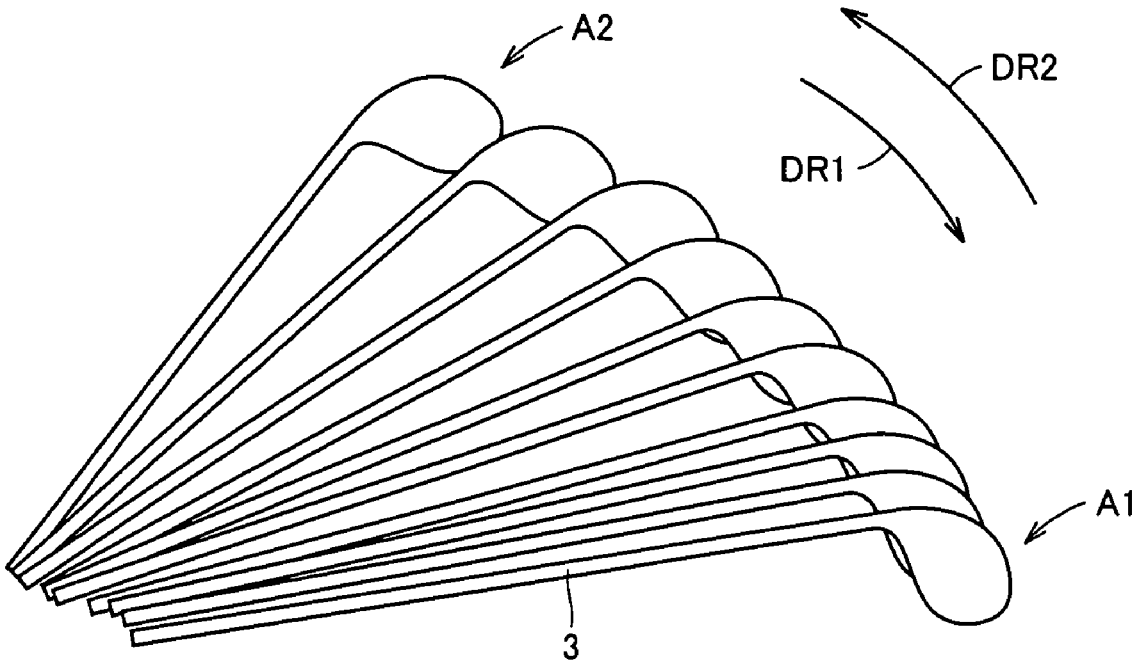
FIG. 3 shows a movement of a golf club around top-of-swing in a golf swing.

FIG. 3 shows a movement of a golf club around top-of-swing by frame advance (0.01 second intervals). The image shown in FIG. 3 is shot by high-speed camera 1B. Referring to FIG. 3, golf club 3 is positioned at "A2" at 0.1 second before a top-of-swing time point, then moves in a direction of arrow DR1, and thereafter reaches top-of-swing position "A1". Thereafter, golf club 3 moves in a direction of arrow DR2 and goes to the impact position.

By analyzing the image shown in FIG. 3, a moving speed ("swing speed") of a club head at a predetermined time before (for example, 0.08 seconds before) reaching top-of-swing can be detected. Similarly, a club head acceleration ("swing acceleration") around top-of-swing can also be detected. The "swing speed" and "swing acceleration" can be indications of the "swing tempo".

Figure 4:
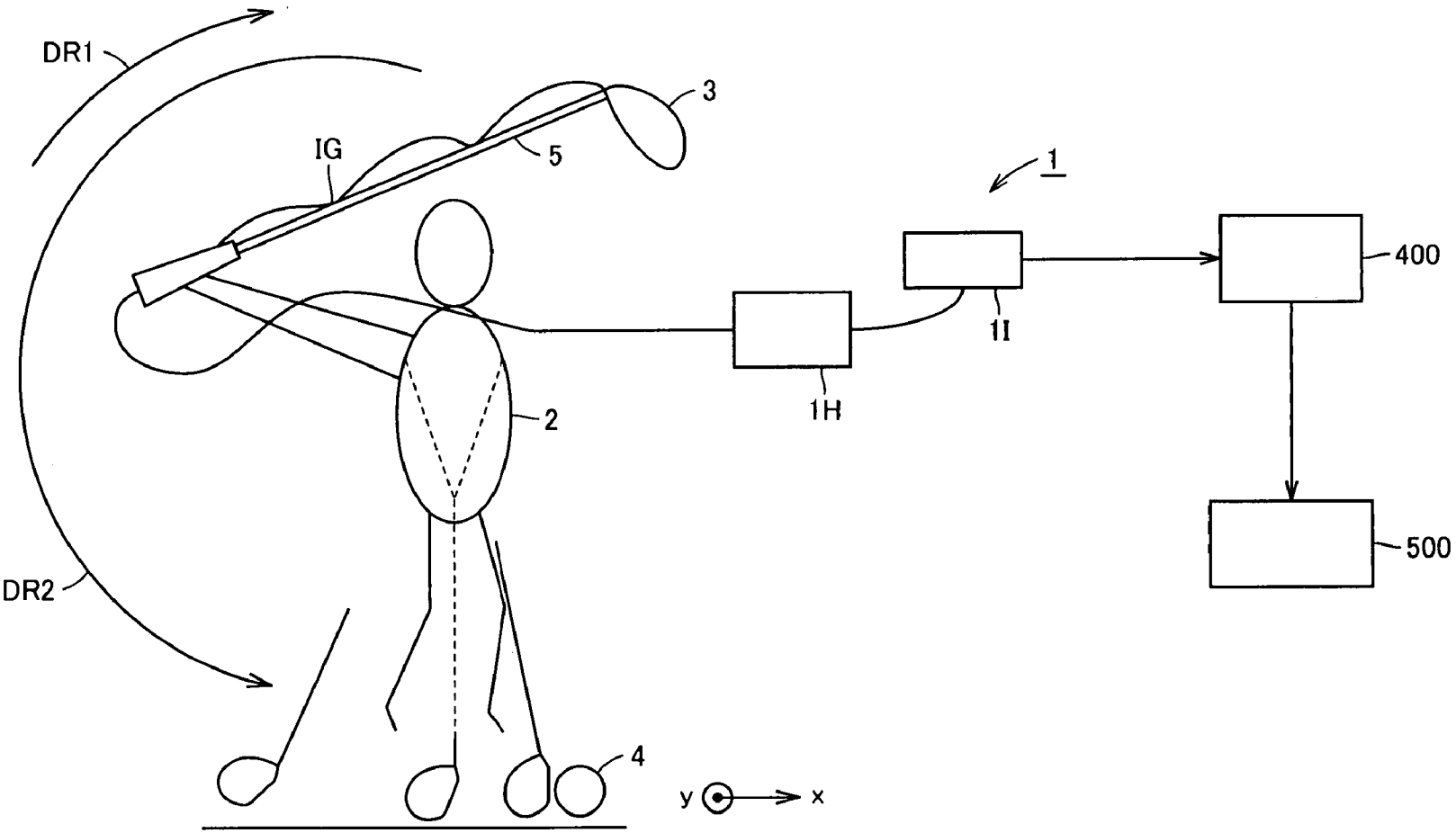
FIG. 4 is a block diagram showing a configuration of a modification of the swing analyzing apparatus shown in FIG. 1.
Figure 5:
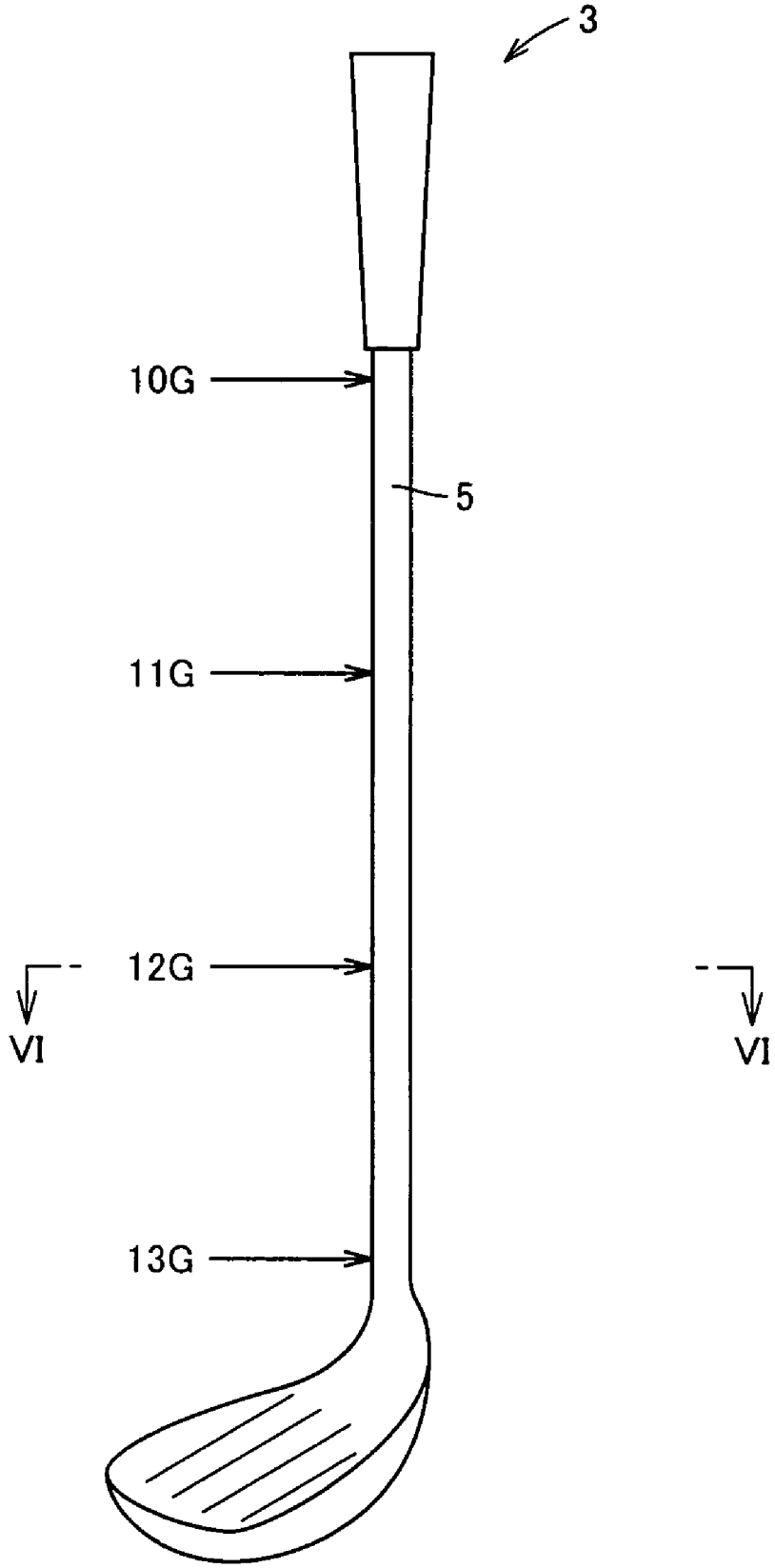
FIG. 5 shows a golf club used in swing analysis with the swing analyzing apparatus shown in FIG. 4.
Figure 6:
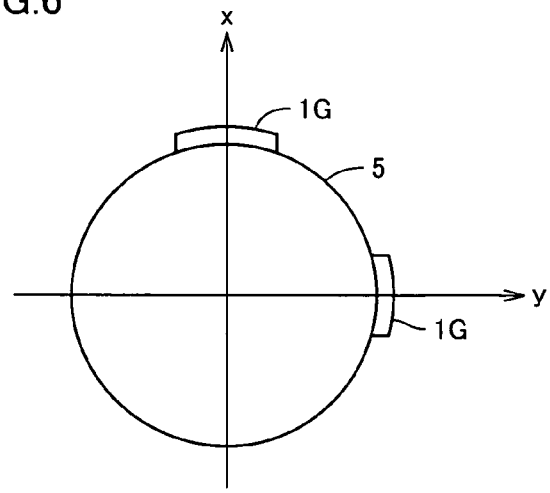
FIG. 6 shows a VI-VI cross section in FIG. 5.

FIG. 4 is a block diagram showing a configuration of a modification of the swing analyzing apparatus shown in FIG. 1. FIG. 5 shows a golf club used in swing analysis with the swing analyzing apparatus shown in FIG. 4, while FIG. 6 shows a VI-VI cross section in FIG. 5. Referring to FIG. 4, swing analyzing apparatus 1 according to the present modification includes deformation gages 1G attached to club shaft 5, a bridge box 1H and an amplifier 1I. As shown in FIG. 5, deformation gages 1G are respectively arranged at a plurality of deformation gage attaching positions 10G-13G provided along the longitudinal direction of club shaft 5. Additionally, as shown in FIG. 6, deformation gages 1G are attached to club shaft 5 at a side in the target line direction (x-axis direction) and a side in a direction perpendicular to the target line direction (y-axis direction). From a composite deformation amount, which is a composite of a deformation amount in the x-axis direction and that in the y-axis direction, a deflection amount of golf club shaft 5 can be determined.

Referring back to FIG. 4, with deformation gages 1G, a deformation amount of club shaft 5 during a swing is detected. The detected deformation amount is sent to selecting unit 400 that is a computer having CPU through bridge box 1H and amplifier 1I, and displayed on displaying apparatus 500. Thus, variations in a deflection amount of a club shaft 5 during a swing is measured. The deflection amount of club shaft 5 takes on the maximum value around top-of-swing. This "maximum deflection amount" can be an indication of the "swing tempo". It should be noted that, in general, the preferable "maximum deflection amount" during a swing is about 70-130 mm (more preferably, about 100 mm).

As described above, in the golf club selecting system according to the present embodiment, the swing tempo of a golfer is detected based on any of the maximum deflection amount (the maximum deformation amount) of a shaft during a swing, the swing time period, the club head speed (swing speed) at a predetermined time before reaching top-of-swing, and the club head acceleration (swing acceleration) around the top-of-swing. The "swing tempo" that is necessary for selecting a golf club shaft can precisely be detected using any of those parameters.

As for head speed detecting unit 100, a measurement apparatus that is commercially available can be used.

On the other hand, a correction of the measurement result is necessary, as the head speed may be measured faster or slower depending on each measurement apparatus.

Figure 7:
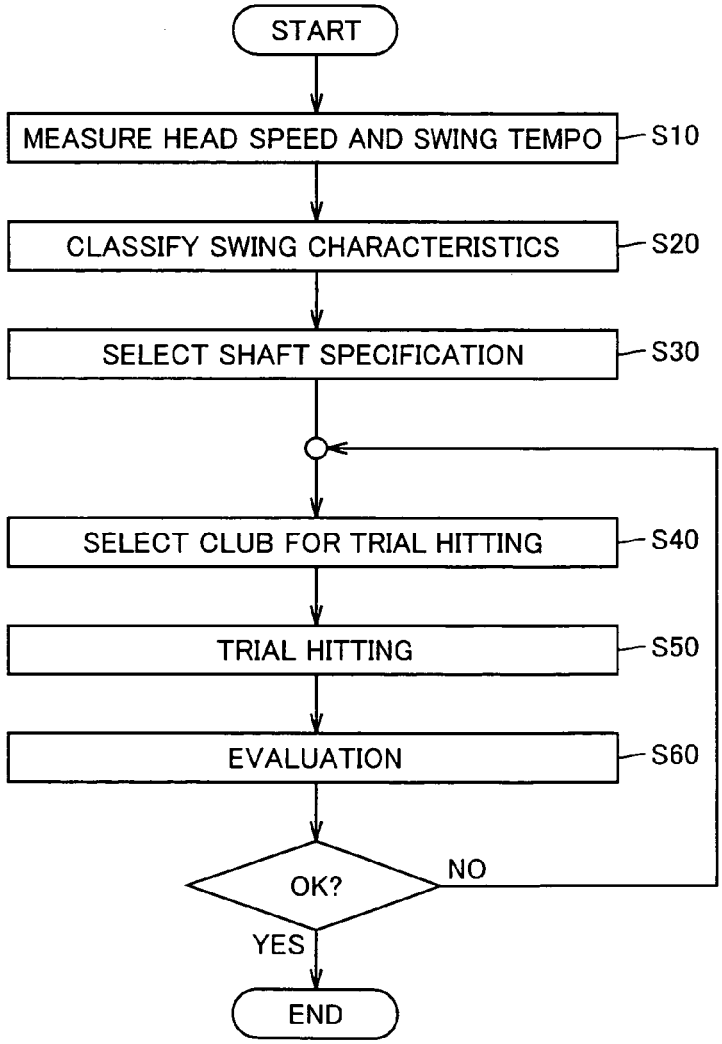
FIG. 7 is a flowchart describing a golf club shaft selecting method according to one embodiment of the present invention.

FIG. 7 is a flowchart describing a golf club shaft selecting method according to the present embodiment. Referring to FIG. 7, at S10, the head speed at impact and the swing tempo in a swing are measured. This measurement is performed using, for example, swing analyzing apparatus 1 shown in FIGS. 2 and 4.

Next, at S20, the characteristics of the swing of the golfer are classified based on the measurement result of swing analyzing apparatus 1. That is, to which group, among a plurality of groups prepared in advance, the head speed and swing tempo of the golfer belong is determined.

At S30, based on the classification result above, a club shaft corresponding to the swing characteristics (the head speed and the swing tempo) of the golfer is selected. Here, chart 300, which has first chart 310 indicative of a preferable shaft mass according to the head speed at impact and the swing tempo and second chart 320 indicative of a preferable shaft flex point according to the head speed at impact and the swing tempo, is referred to. It is noted that the golf club shaft(s) selected at S30 may be one or may be plural (for example, two or three).

Subsequently, at S40, a golf club having the selected club shaft is selected. Then, at S50, trial hitting with the selected golf club is performed. At S60, the golf club with which the trial hitting was performed is evaluated. Here, for example objective data such as "head speed", "ball speed", "striking ability", "ball spin amount", "launch angle", "variations in hitting position", "variations in trajectory", as well as the feeling of a golfer such as "easy to adjust timing/hard to adjust timing" "easy to swing/hard to swing" can be used as criterion for evaluation.

As a result of the evaluation at S60, when the golfer is fully satisfied, the series of selection steps end. When the golfer is not fully satisfied, the process goes back to S40 again. In other words, another golf club having the selected club shaft is selected, and trial hitting with this golf club is performed.

Summarizing the above, the golf club shaft selecting method according to the present embodiment includes the steps of: detecting a head speed at impact in a swing of a golfer and a swing tempo of the golfer (S10); classifying the swing of the golfer based on a detection result from the step of detecting (S20); and selecting a golf club shaft having a shaft mass and a shaft flex point suitable for the golfer based on a classification result from the step of classifying (S30).

The present inventors have confirmed the existence of a certain relationship between the swing type of a golfer (the head speed at impact and the swing tempo) and the shaft mass and the shaft flex point suitable for the golfer. Accordingly, by the club shaft selecting method above, an objective selection criterion can be obtained as to the shaft mass and the shaft flex point.

Additionally, the present inventors have confirmed the immediate relationship between the flexural rigidity of the club shaft at the central portion in the longitudinal direction and the flexural rigidity of the club shaft at the grip portion, in selecting the shaft flex point corresponding to the swing characteristics of each golfer. Accordingly, by performing the classification of the shaft flex point to be the selection target based on the relationship between the slope of a flexural rigidity distribution of the shaft at a portion positioned on the club head side relative to the shaft central portion and the slope of a flexural rigidity distribution of the shaft at a portion positioned on the grip side relative to the shaft central portion, the selection of the shaft flex point more suitable for each golfer can be achieved.

It should be noted that, while in the present embodiment, the description has mainly been provided as to the case where chart 300 has first chart 310 indicative of a preferable shaft mass corresponding to the head speed at impact and the swing tempo and second chart 320 indicative of a preferable shaft flex point corresponding to the head speed at impact and the swing tempo, chart 300 may have only first chart 310 or may have only second chart 320. When chart 300 has only first chart 310, selection of a club shaft having a shaft mass suitable for each golfer is supported, and when chart 300 has only second chart 320, selection of a club shaft having a shaft flex point suitable for each golfer is supported.

EXAMPLE

Figure 8:
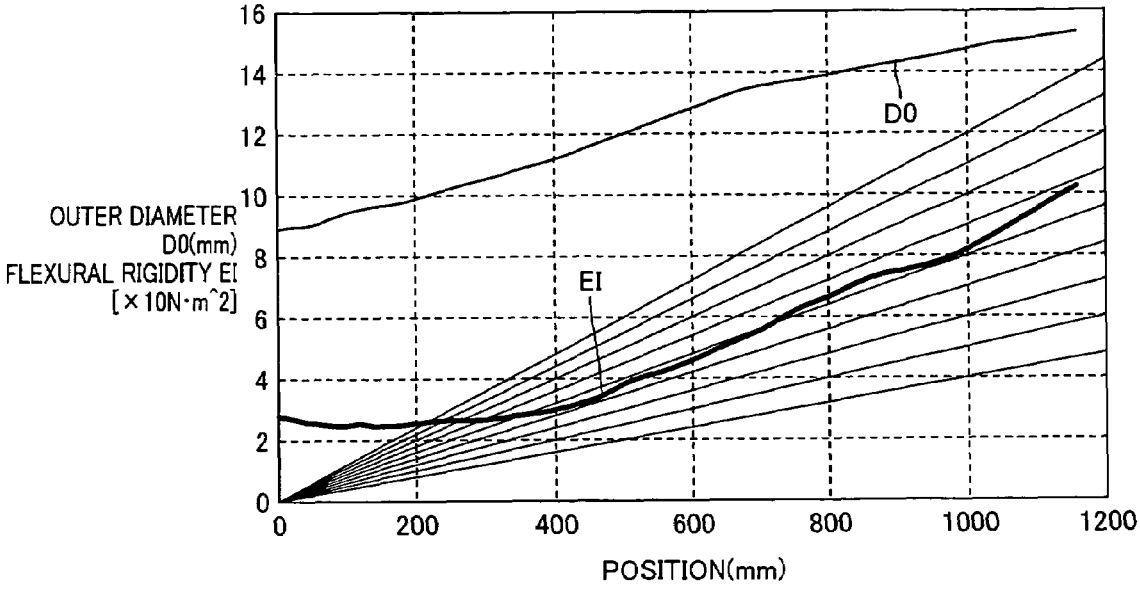
FIG. 8 shows a distribution of outer diameter and flexural rigidity of a golf club shaft used in a golf club shaft selecting method according to one example of the present invention.

FIG. 8 shows a distribution of outer diameter and flexural rigidity of a golf club shaft used in a golf club shaft selecting method according to one example of the present invention. The abscissa in FIG. 8 (and FIGS. 11-14) indicates the distance from the club head side end of a golf club shaft. In the example of FIG. 8, the outer diameter and flexural rigidity of a golf club increases from the club head side toward the grip side.

Figure 9:
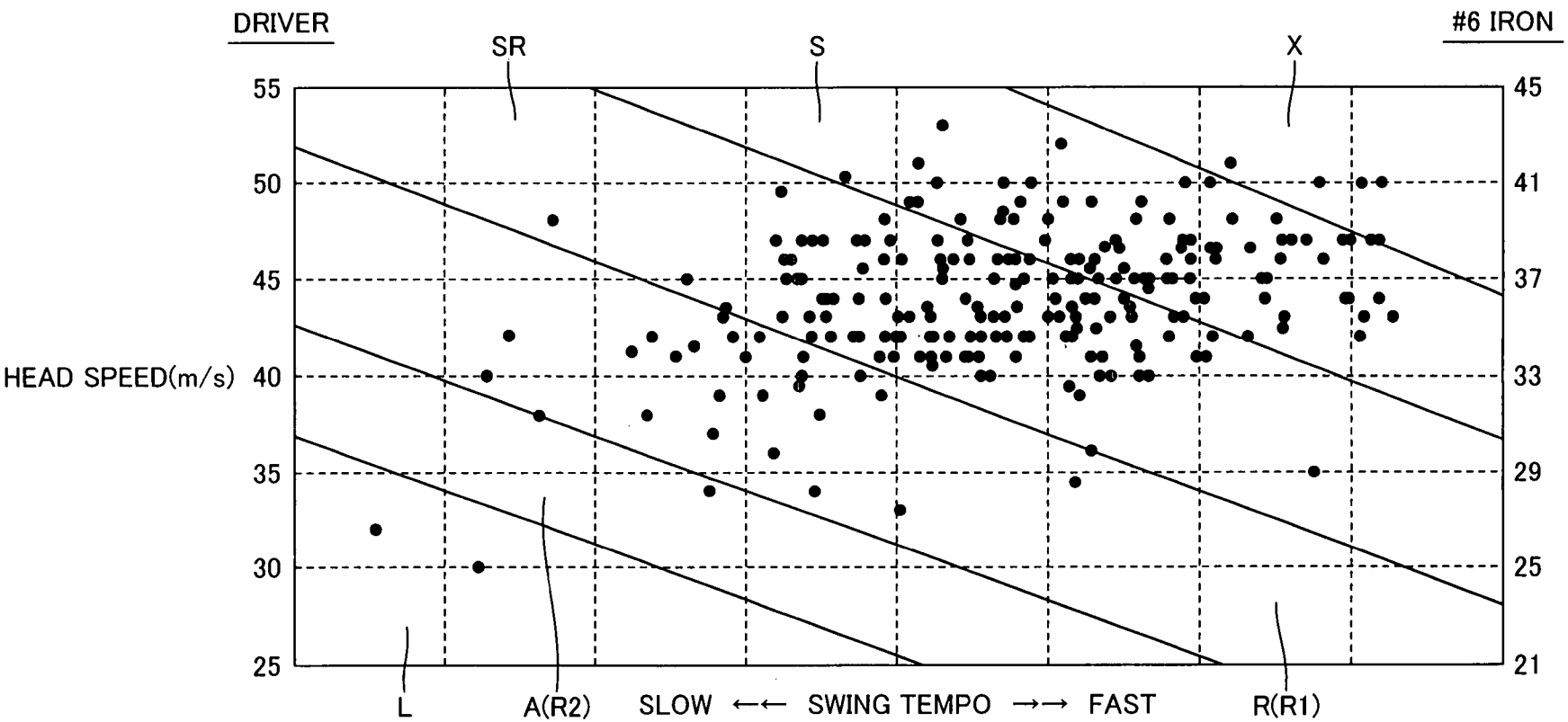
FIG. 9 shows a distribution of head speed and swing tempo detected by the step of detecting in the golf club shaft selecting method according to one example of the present invention.

FIG. 9 shows a distribution of head speed and swing tempo detected by the step of detecting in the golf club shaft selecting method according to the present example. In the present Example, measurement was performed using golf clubs (drivers and #6 irons) with golf club shafts having the outer diameter and flexural rigidity distribution shown in FIG. 8. FIG. 9 shows the result of measurements on the swing of at least 300 golfers. In FIG. 9, the flexes of shaft (X flex (#X), S flex (#S), SR flex (#SR), R (R1) flex (#R), A (R2) flex (#A), and L flex (#L)) suitable for each golfer are shown together. Referring to FIG. 9, a relatively stiff golf club shaft (such as X flex or S flex) is suitable for a golfer with fast head speed and fast swing tempo, while a relatively soft golf club shaft (such as A(R2) flex or L flex) is suitable for a golfer with slow head speed and slow swing tempo.

As shown in FIG. 9, a correlation is not necessarily found between the swing tempo and the head speed (at impact). Accordingly, in classifying the swing characteristics of each golfer, both the swing tempo and the head speed must be considered.

Figure 10:
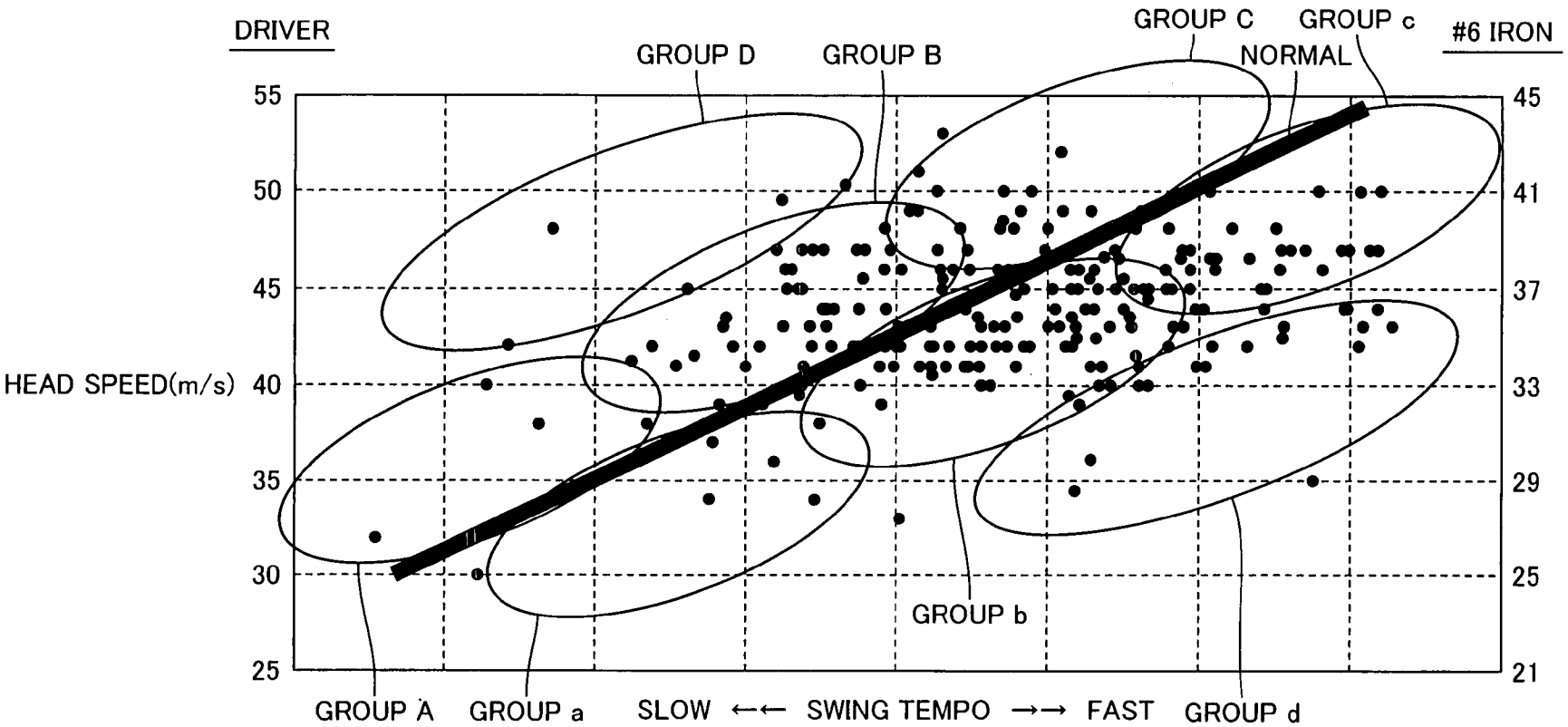
FIG. 10 is an explanatory graph of the classification of golfers by the head speed and the swing tempo shown in FIG. 9.
Figure 11:
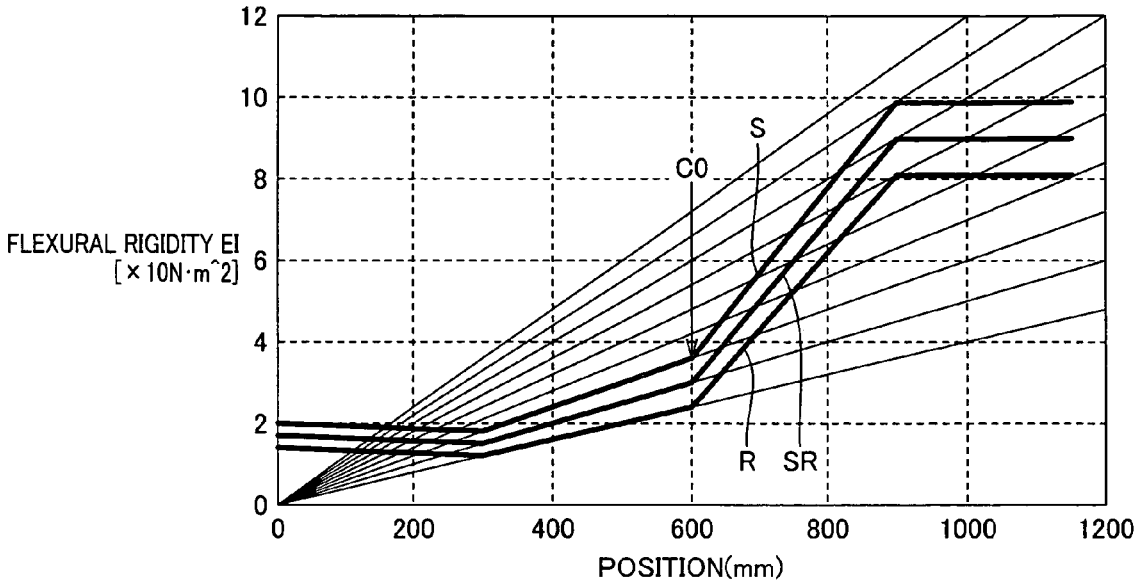
FIGS. 11-14 show the flexural rigidity distribution of golf club shafts used in a golf club shaft selecting method according to one example of the present invention.
Figure 12:
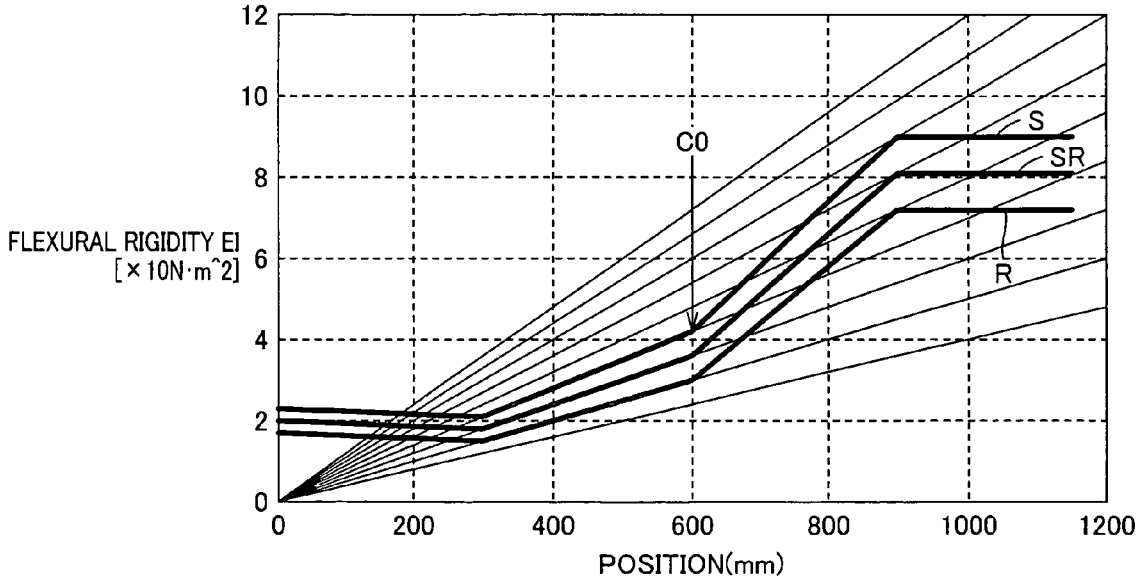
Figure 13:
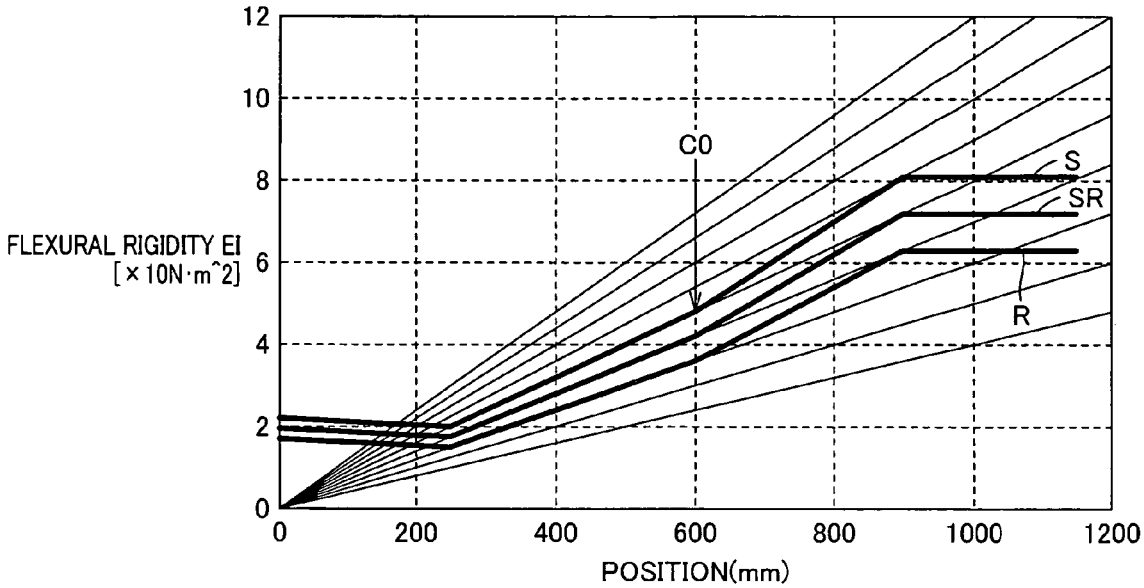
Figure 14:
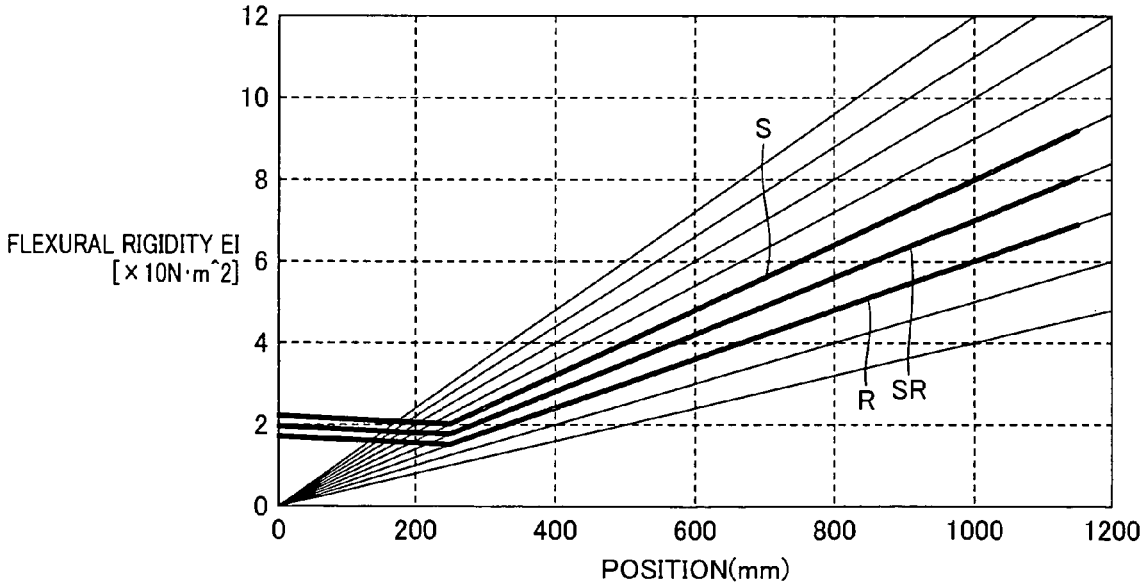

FIG. 10 is an explanatory graph of the classification of golfers by the swing characteristics. Referring to FIG. 10, each golfer is classified into groups a-d and groups A-D corresponding to the swing characteristics (the swing tempo and the head speed) of him/her. In FIG. 10, the NORMAL line indicates the line where the head speed, the swing tempo and the preference of shaft flex point are at the average level (how the NORMAL line was determined will be described later). Here, the golfers distributed in the upper left area relative to the NORMAL line (for example, those golfers included in group D) correspond to the golfers with "slow swing tempo for the head speed". In FIG. 10, the golfers distributed in the lower right area relative to the NORMAL line (for example, those golfers included in group d) correspond to the golfers with "fast swing tempo for the head speed". In FIG. 10, the golfers distributed on and around the NORMAL line correspond to the golfers at "the average level as to the relationship among the head speed, swing tempo and the shaft flex point", for example, the golfers of a boundary region belonging to any of groups A-C and groups a-c.

FIGS. 11-14 show the flexural rigidity distribution of sample golf clubs. Examples in FIGS. 11-14 show different ratio between a slope of the flexural rigidity distribution of a portion positioned on the club head side relative to the shaft central portion (C0) and a slope of the flexural rigidity distribution of a portion positioned on the grip side relative to the shaft central portion (C0). Here, they are referred to as "Butt Stiff+(plus)" (FIG. 11), "Butt Stiff" (FIG. 12), "Butt Standard" (FIG. 13), "Butt Standard−(minus)" (FIG. 14), in the descending order as to the magnitude of a slope of the flexural rigidity distribution of a portion positioned on the grip side against a slope of the flexural rigidity distribution of a portion positioned on the club head side. FIGS. 11-14 each show examples of S flex, SR flex, and R flex.

In the present Example, a plurality of sample golf clubs were prepared to consider which sample was highly evaluated by golfers classified into each group (A-D, a-d). The list of the prepared sample golf clubs are shown in Table 1. Tables 2-5 show, for each sample golf club, the groups in which a relatively large number of (here, at least five) golfers selected the golf club for easier hitting (that is, highly evaluated).

TABLE 1

| Club Shaft Mass (g) [approx.] | Golf Club (Driver) Mass (g) [approx.] | Shaft Flex L | A | R | SR | S | X |
|---|---|---|---|---|---|---|---|
| 40 | 270-290 | * | * | * | — | — | — |
| 50 | 290-305 | — | * | * | * | * | — |
| 60 | 305-315 | — | — | * | * | * | — |
| 70 | 315-325 | — | — | * | * | * | * |
| 80 | 325-335 | — | — | — | * | * | * |

*: Sample Available

—: Sample Not Available

TABLE 2

Shaft Flex Point Pattern: Butt Stiff+

| Club Shaft Mass (g) [approx.] | Golf Club (Driver) Mass (g) [approx.] | Shaft Flex L | A | R | SR | S | X |
|---|---|---|---|---|---|---|---|
| 40 | 270-290 | 0 | 0 | 0 | — | — | — |
| 50 | 290-305 | — | 0 | a/d | a/b/d | d | — |
| 60 | 305-315 | — | — | 0 | b/d | b/c/d | — |
| 70 | 315-325 | — | — | 0 | 0 | 0 | 0 |
| 80 | 325-335 | — | — | — | 0 | 0 | 0 |

—: Sample Not Available,

0: Little Selected

TABLE 3

Shaft Flex Point Pattern: Butt Stiff

| Club Shaft Mass (g) [approx.] | Golf Club (Driver) Mass (g) [approx.] | Shaft Flex L | A | R | SR | S | X |
|---|---|---|---|---|---|---|---|
| 40 | 270-290 | a | a/A | a/A | — | — | — |
| 50 | 290-305 | — | a | a | a/b/d B | 0 | — |
| 60 | 305-315 | — | — | b | b/d | b/c/d B | — |
| 70 | 315-325 | — | — | 0 | b | c/C | c/C |
| 80 | 325-335 | — | — | — | 0 | c | c |

—: Sample Not Available

0: Little Selected

TABLE 4

Shaft Flex Point Pattern: Butt Standard

| Club Shaft Mass (g) [approx.] | Golf Club (Driver) Mass (g) [approx.] | Shaft Flex L | A | R | SR | S | X |
|---|---|---|---|---|---|---|---|
| 40 | 270-290 | A/a | A/a | A | — | — | — |
| 50 | 290-305 | — | A | A/B/b | B/b | 0 | — |
| 60 | 305-315 | — | — | B | B/C/c | B/C/c | — |
| 70 | 315-325 | — | — | 0 | B/C/D | C/D | C |
| 80 | 325-335 | — | — | — | 0 | C/D | C |

—: Sample Not Available

0: Little Selected

TABLE 5

Shaft Flex Point Pattern: Butt Standard−

| Club Shaft Mass (g) [approx.] | Golf Club (Driver) Mass (g) [approx.] | Shaft Flex L | A | R | SR | S | X |
|---|---|---|---|---|---|---|---|
| 40 | 270-290 | 0 | 0 | 0 | — | — | — |
| 50 | 290-305 | — | 0 | 0 | 0 | 0 | — |
| 60 | 305-315 | — | — | 0 | 0 | 0 | — |
| 70 | 315-325 | — | — | D | B/C/D | C/D | 0 |
| 80 | 325-335 | — | — | — | D | C/D | 0 |

—: Sample Not Available

0: Little Selected

Referring to Tables 2-5, as to the shaft mass, the golfers of group B tend to evaluate club shafts of greater mass higher than the golfers of group A do, and the golfers of group C tend to evaluate club shafts of greater mass higher than the golfers of group B do. Further, the golfers of group D tend to evaluate the club shafts of greater mass higher than the golfers of group A do.

Similarly, the golfers of group b tend to evaluate club shafts of greater mass higher than the golfers of group a do, and the golfers of group c tend to evaluate club shafts of greater mass higher than the golfers of group b do. Further, the golfers of group d tend to evaluate the club shafts of greater mass higher than the golfers of group a do.

As to the shaft flex point, while the golfers of groups A-D tend to evaluate the club shafts of "Butt Standard" or "Butt Standard−" relatively highly, the golfers of groups a-d tend to evaluate the club shafts of "Butt Stiff" or "Butt Stiff+" relatively highly.

Among the golfers of groups A-D, the golfers of groups A-C tend to evaluate the club shafts of "Butt Standard" relatively highly, the golfers of group D tend to evaluate the club shafts of "Butt Standard−" relatively highly.

Among the golfers of groups a-d, the golfers of groups a-c tend to evaluate the club shafts of "Butt Stiff" relatively highly, the golfers of group d tend to evaluate the club shafts of "Butt Stiff+" relatively highly.

Now, the aforementioned NORMAL line, that is, "the relationship among the head speed, the swing tempo and the preference of the shaft flex point being at the average level" is described.

As the shaft flex point, the present inventors noted the difference between a slope of a straight line passing through a flexural rigidity value of a shaft at a portion positioned on the club head side relative to the shaft central portion and the origin point, and a maximum of a slope of a flexural rigidity value of the shaft at a portion positioned on the grip side relative to the shaft central portion and the origin point. The difference of the slopes: 20 $Nm^2/1000$ mm was employed as the boundary value, and the difference of the slopes greater than the boundary value was defined as "Butt Stiff (including Butt Stiff+)" and the difference of the slopes at most at the boundary value was defined as "Butt Standard (including Butt Standard−)". Under such a condition, based on data showing which golf clubs with which type of shaft flex point were highly evaluated by at least 300 golfers as "the clubs easier to hit" and data of the head speed and the swing tempo, and using the discriminant analysis by the linear discriminant function, that is one multivariate analysis scheme, the "NORMAL line" that is the boundary line was derived.

In the following, based on the aforementioned "NORMAL line", the charts used for the club shaft selection are described.

Figure 15:
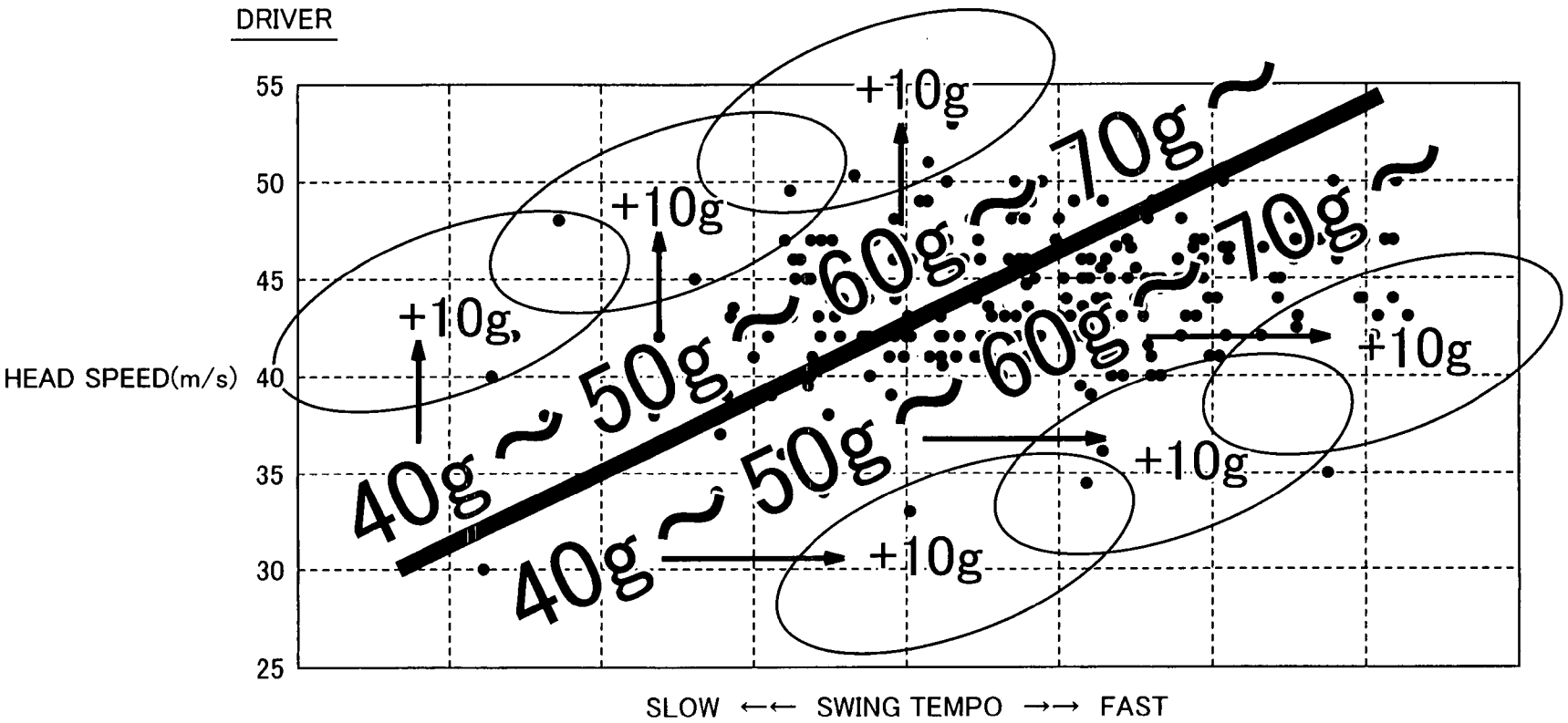
FIG. 15 is a chart showing preferable shaft mass used in a golf club shaft selecting method according to one example of the present invention.
Figure 16:
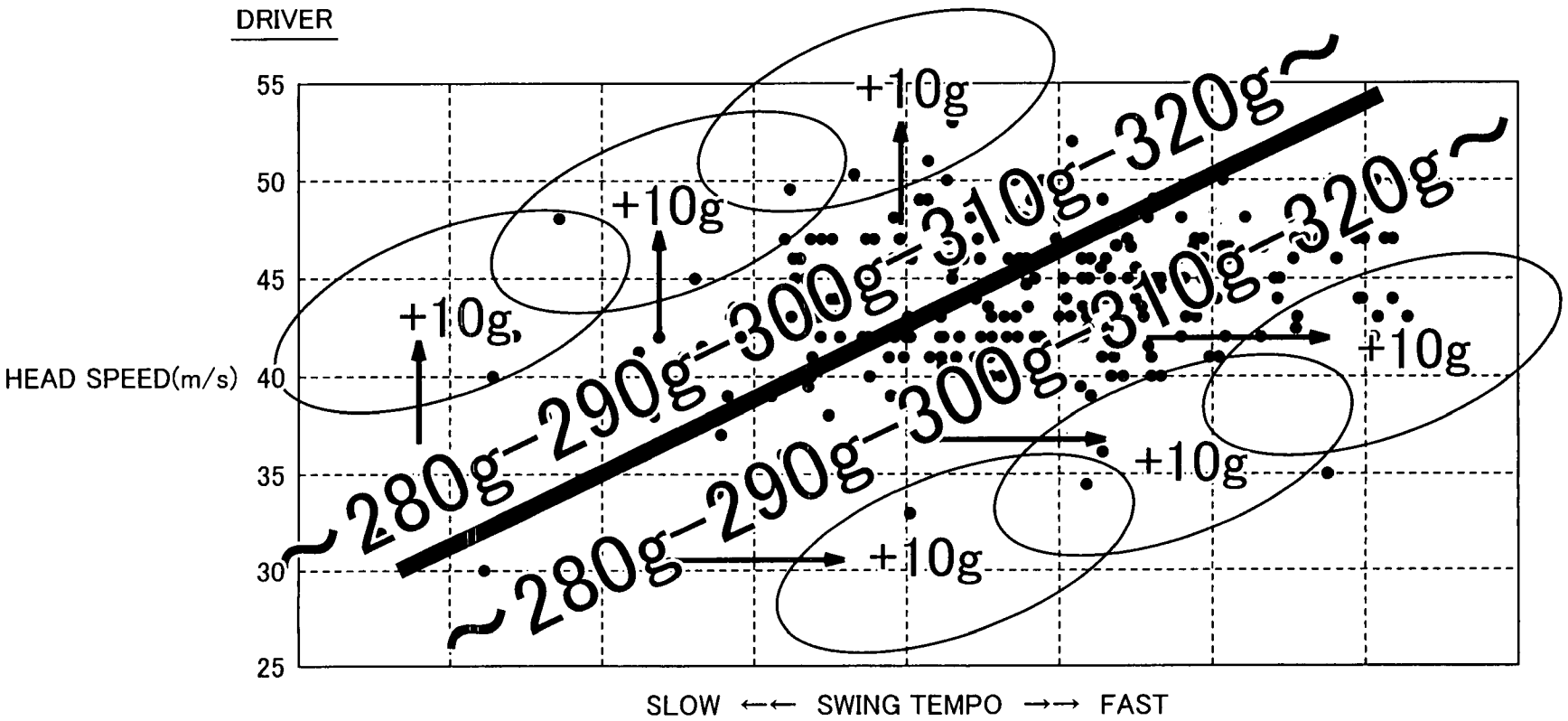
FIG. 16 is a chart showing preferable golf club mass used in a golf club shaft selecting method according to one example of the present invention.
Figure 17:
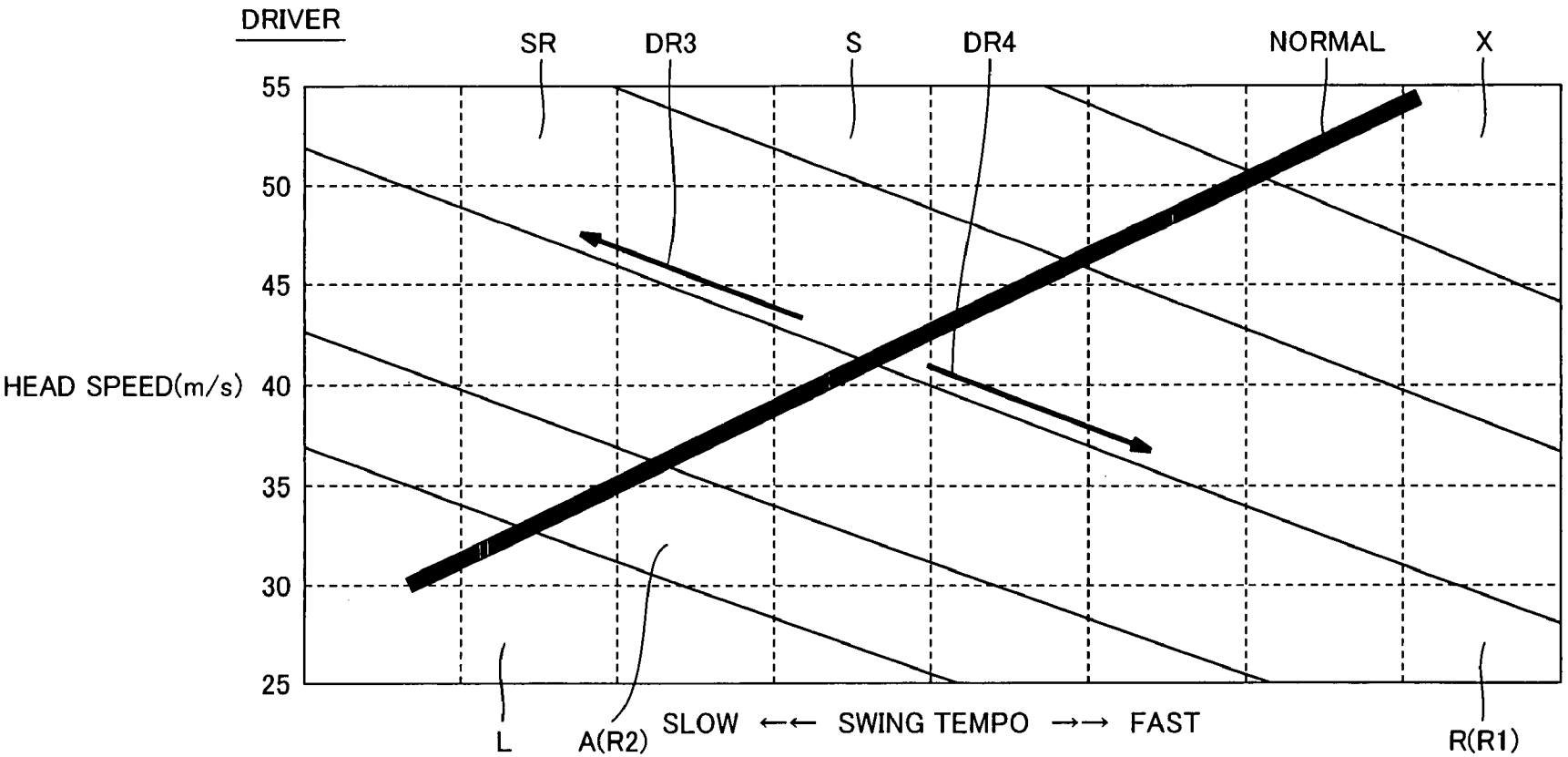
FIG. 17 is a chart showing the tendency of preferable shaft flex points used in a golf club shaft selecting method according to one example of the present invention.

FIG. 15 is a chart showing preferable shaft mass (for drivers), FIG. 16 is a chart showing preferable golf club mass (drivers), and FIG. 17 is a chart showing preferable shaft flex point. The expression such as "40 g", "50 g" and the like represents the preferable shaft mass (FIG. 15) and the club mass (FIG. 16) in that area. FIGS. 15-17 reflect the evaluation results shown in tables 2-5.

Referring to FIGS. 15 and 16, as to the golfers distributed near the NORMAL line (groups A-C, groups a-d), the club shafts (golf clubs) with greater mass are suitable for the golfers with faster swing tempo (faster head speed). On the other hand, for the golfers with "slow swing tempo for the head speed" (group D), the club shafts (golf club) greater in mass by about 10 g than that for the golfers distributed near the NORMAL line with similar swing tempo, are suitable. For the golfers with "fast swing tempo for the head speed" (group d), the club shafts (golf club) greater in mass by about 10 g than that for the golfers distributed near the NORMAL line with similar head speed, are suitable.

Referring to FIG. 17, for the golfers distributed in arrow DR3 direction relative to the NORMAL line (groups A-D), the club shafts of "Butt Standard" or "Butt Standard −" are suitable, which are flexible in their entirety in the longitudinal direction including the grip portion. On the other hand, for the golfers distributed in arrow DR4 direction relative to the NORMAL line (groups a-d), the club shafts of "Butt Stiff" or "Butt Stiff+" are suitable, of which grip portion is stiff.

Figure 18:
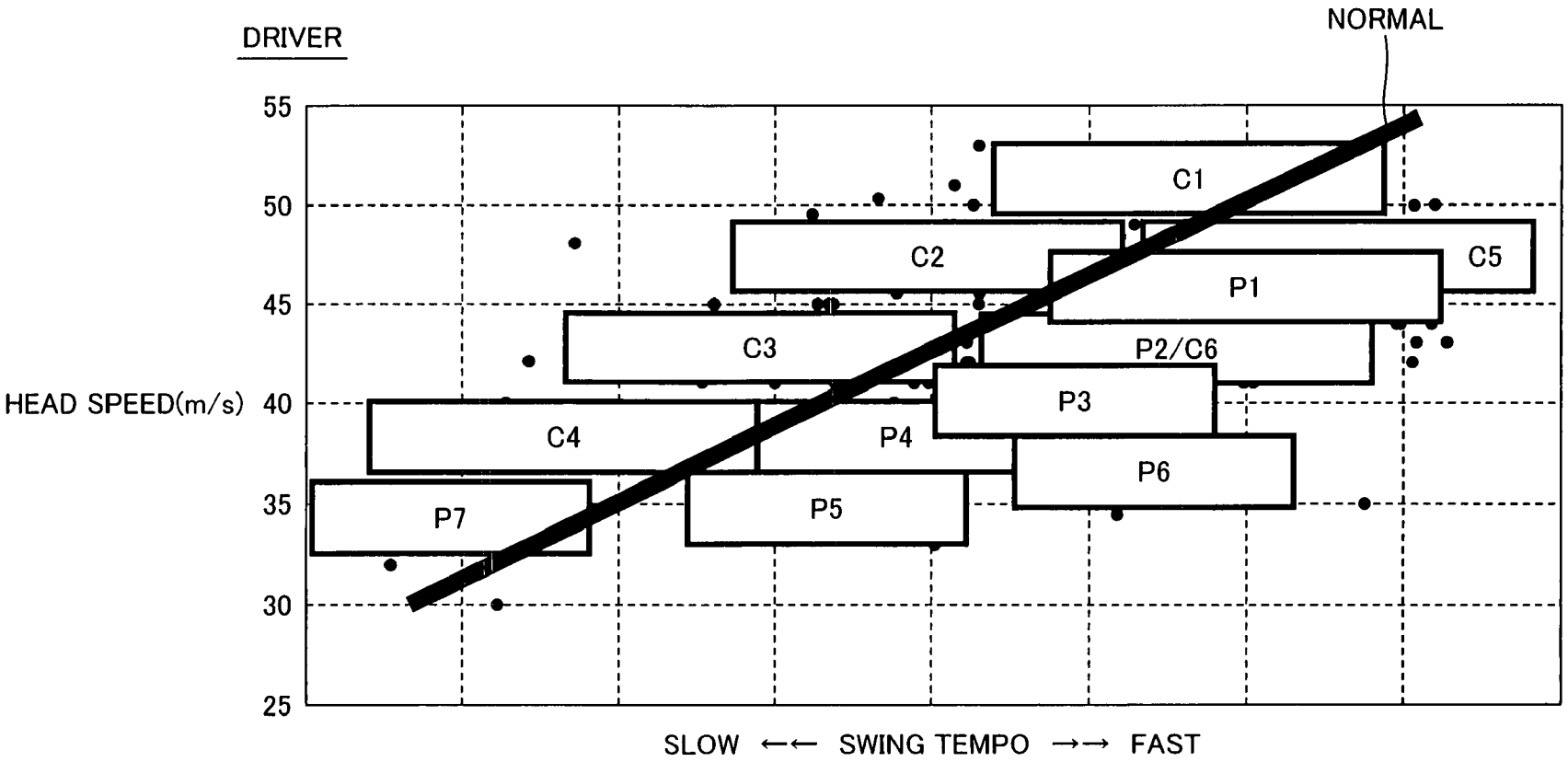
FIG. 18 shows relationship between swing characteristics of golfers and preferable golf club shafts.

FIG. 18 shows the relationship between the swing characteristics of golfers and the preferable golf club shafts (types C1-C6, types P1-P7). In the example shown in FIG. 18, by the club shafts (for drivers) of 13 types, the golfers of most areas are covered. In other words, by selecting any of types C1-C6 and types P1-P7, golf club shafts that can fully satisfy most of the golfers can be obtained. It is noted that, as areas respectively covered by shafts of type P2 and type C6 are substantially equal, the area is shown as P2/C6.

Figure 19:
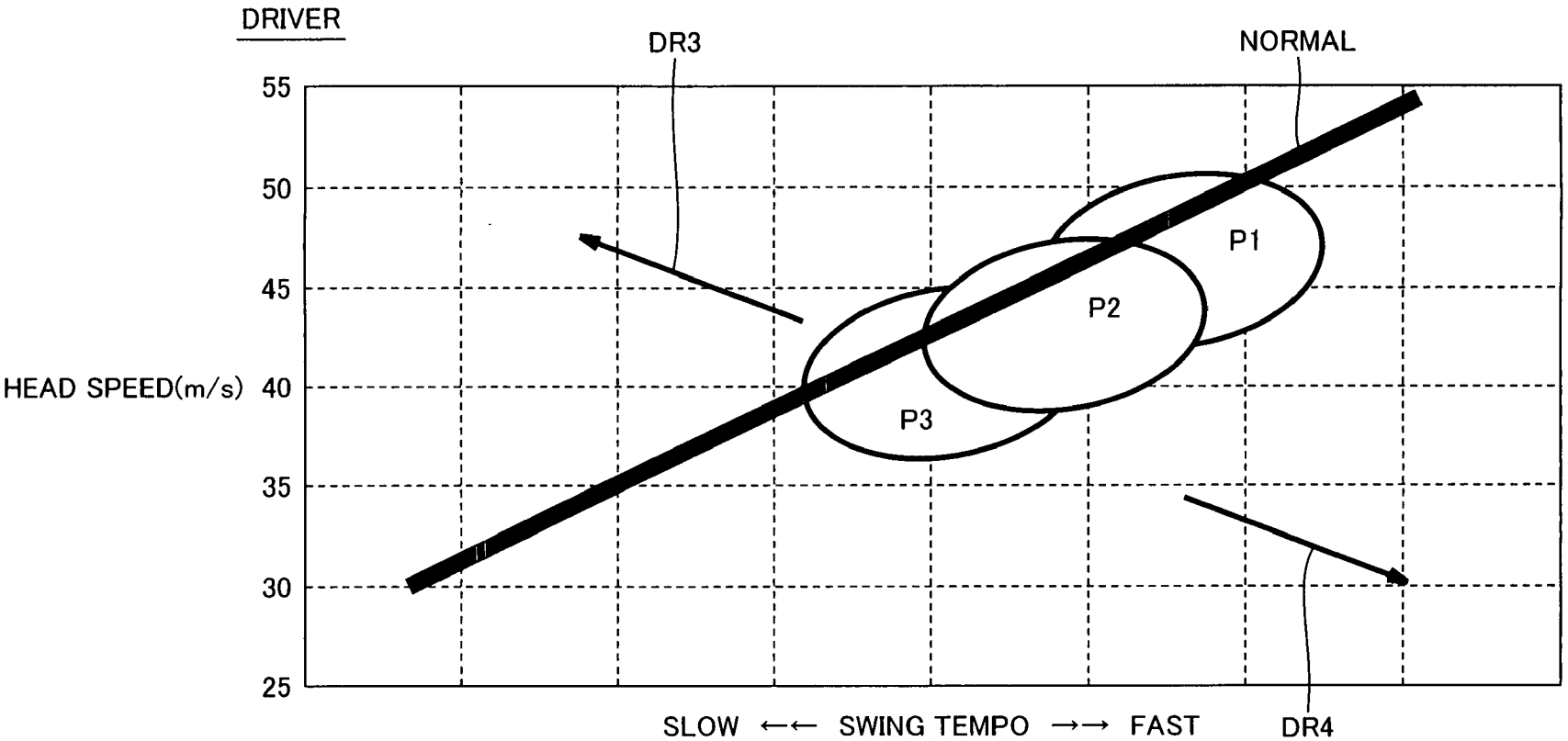
FIGS. 19-21 show relationship between swing characteristics of golfers and preferable golf clubs.
Figure 20:
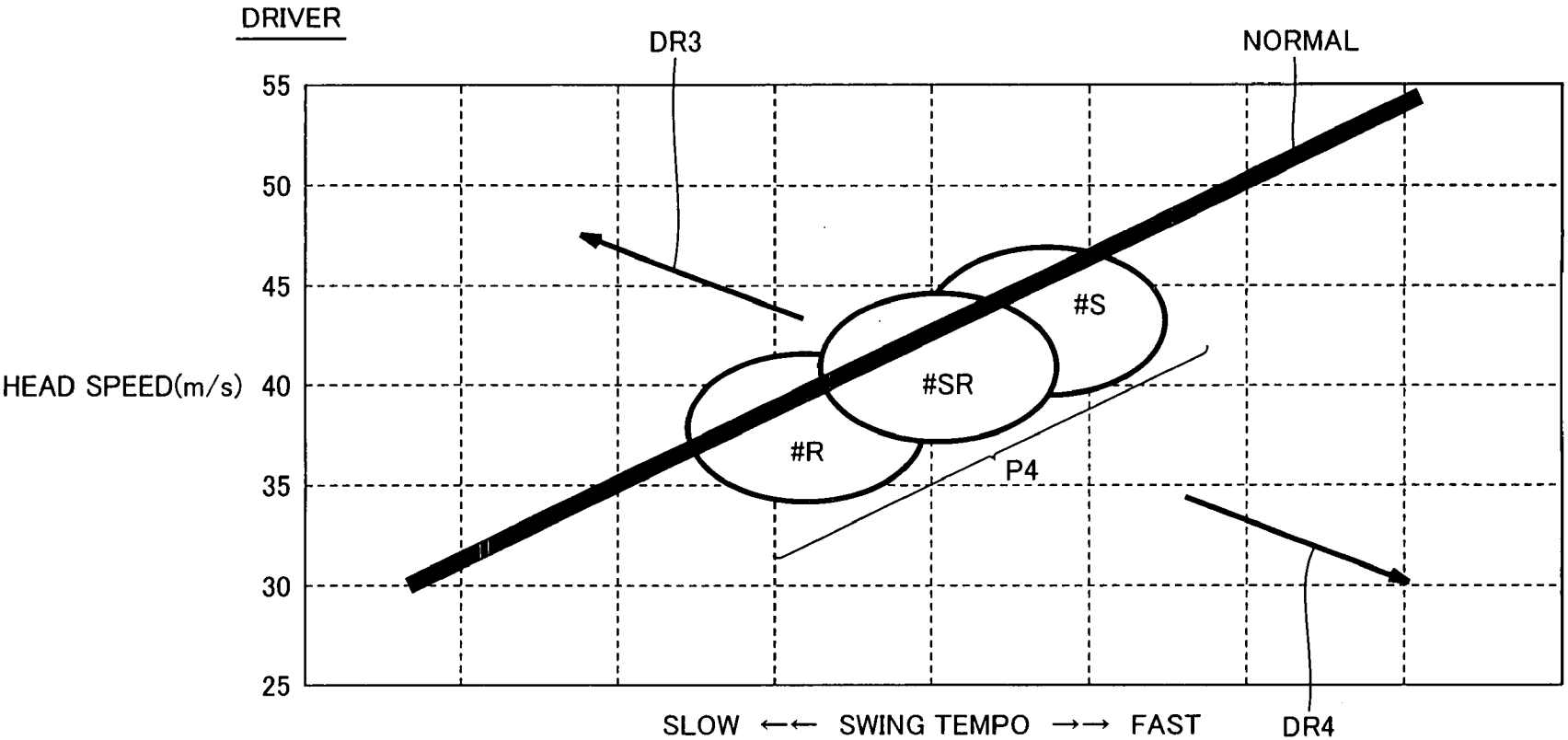
Figure 21:
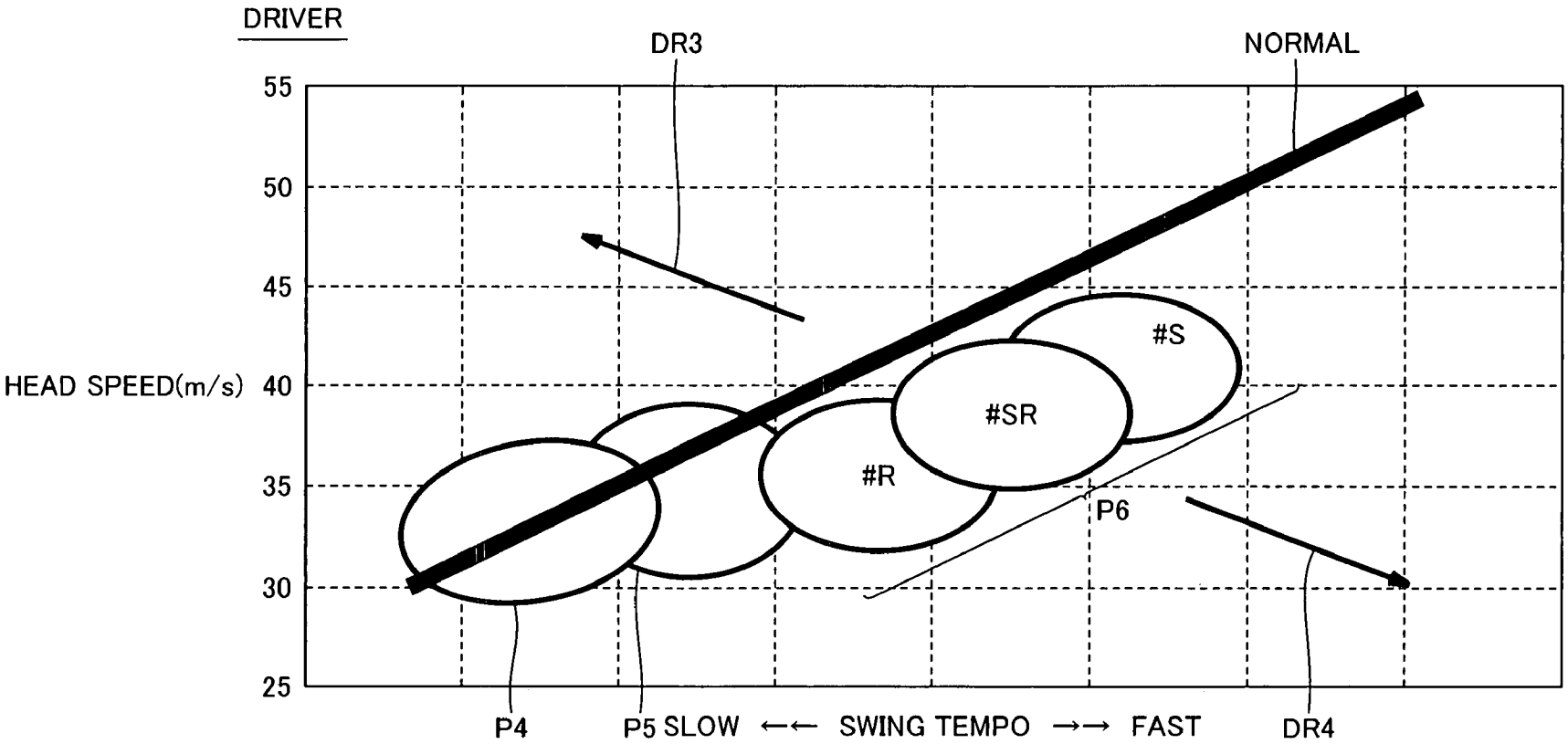

FIGS. 19-21 show the relationship between the swing characteristics of golfers and the preferable golf club shafts (types P1-P7). The golf clubs (drivers) of types P1-P7 in FIGS. 19-21 have the club shaft of types P1-P7 shown in FIG. 18.

Referring to FIG. 19, the mass of golf club of type P1 is about 315 g-325 g, and the shaft flex is #SR or #S. The mass of golf club of type P2 is about 305 g-315 g, and the shaft flex is #SR or #S. The mass of golf club of type P3 is about 295 g-305 g, and the shaft flex is #R, #SR or #S.

Referring to FIG. 20, the mass of golf club of type P4 is about 295 g-305 g, and the shaft flex is #R, #SR or #S.

Referring to FIG. 21, the mass of golf club of type P5 is about 285 g-290 g, and the shaft flex is #A or #R. The mass of golf club of type P6 is about 290 g-310 g, and the shaft flex is #R, #SR or #S. The mass of golf club of type P7 is about 265 g-270 g, and the shaft flex is #A or #R.

As shown in FIGS. 19-21, by appropriately selecting a club shaft, a golf club having the mass and shaft flex suitable for each golfer's swing characteristics (head speed and swing tempo) can be obtained. The shaft flex point can also be set as appropriate.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A golf club shaft selecting system, comprising:

head speed detecting means for detecting a head speed at impact in a swing of a golfer;

swing tempo detecting means for detecting a swing tempo of said golfer;

a chart indicative of a preferable shaft flex point corresponding to said head speed and said swing tempo;

selecting means for selecting a golf club shaft suitable for said golfer referring to said chart and based on said head speed and swing tempo detected by said head speed detecting means and said swing tempo detecting means; and displaying means for displaying the golf club shaft selected by said selecting means.

2. The golf club shaft selecting system according to claim 1, wherein classification of said shaft flex point in said chart is based on a relationship between a slope of a flexural rigidity distribution of the shaft at a portion positioned on a club head side relative to a shaft central portion and a slope of a flexural rigidity distribution of the shaft at a portion positioned on a grip side relative to said shaft central portion.

3. The golf club shaft selecting system according to claim 1, wherein said swing tempo detecting means detects the swing tempo of said golfer based on any of a maximum deflection amount or a maximum deformation amount of the shaft in a swing, a swing time period, a club head speed at a prescribed time before reaching top-of-swing, and a club head acceleration around the top-of-swing.

4. A golf club shaft selecting system, comprising:

head speed detecting means for detecting a head speed at impact in a swing of a golfer;

swing tempo detecting means for detecting a swing tempo of said golfer;

a first chart indicative of a preferable shaft mass corresponding to said head speed and said swing tempo;

a second chart indicative of a preferable shaft flex point corresponding to said head speed and said swing tempo;

selecting means for selecting a golf club shaft suitable for said golfer referring to said firs and second charts and based on said head speed and swing temp detected by said head speed detecting means and said swing tempo detecting means; and displaying means for displaying the golf club shaft selected by said selecting means.

5. The golf club shaft selecting system according to claim 4, wherein classification of said shaft flex point in said second chart is based on a relationship between a slope of a flexural rigidity distribution of the shaft at a portion positioned on a club head side relative to a shaft central portion and a slope of a flexural rigidity distribution of the shaft at a portion positioned on a grip side relative to said shaft central portion.

6. The golf club shaft selecting system according to claim 4, wherein said swing tempo detecting means detects the swing tempo of said golfer based on any of a maximum deflection amount or a maximum deformation amount of the shaft in a swing, a swing time period, a club head speed at a prescribed time before reaching top-of-swing, and a club head acceleration around the top-of-swing.

* * * * *